US007625317B2

(12) United States Patent
Stevenson et al.

(10) Patent No.: US 7,625,317 B2
(45) **Date of Patent: *Dec. 1, 2009**

(54) EXERCISE APPARATUS WITH COUPLED MOTION MECHANISM

(75) Inventors: Mark D. Stevenson, Lombard, IL (US); Joseph Immordino, Hoffman Estates, IL (US); Marcos D. Roimicher, Lombard, IL (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/941,123

(22) Filed: Nov. 16, 2007

(65) Prior Publication Data

US 2009/0131227 A1 May 21, 2009

(51) Int. Cl.
*A63B 22/16* (2006.01)

(52) U.S. Cl. ..... 482/51; 482/52; 482/54; 482/80; 482/142; 482/146

(58) Field of Classification Search ..... 482/51, 482/146

See application file for complete search history.

(56) References Cited

U.S. PATENT DOCUMENTS 3,511,500 A * 5/1970 Dunn ..... 482/113
3,756,595 A * 9/1973 Hague ..... 482/51
4,953,858 A * 9/1990 Zelli ..... 482/147
5,058,951 A * 10/1991 Thiel ..... 297/278
5,078,389 A * 1/1992 Chen ..... 482/8
5,242,340 A * 9/1993 Jerome ..... 482/52
5,318,488 A * 6/1994 Babcock ..... 482/51
5,334,123 A * 8/1994 Rutherford ..... 482/144
5,399,140 A * 3/1995 Klippel ..... 482/146
5,433,690 A * 7/1995 Gilman ..... 482/146
5,518,470 A * 5/1996 Piaget et al. ..... 482/51
5,547,253 A * 8/1996 Schwartz et al. ..... 297/338
5,582,567 A * 12/1996 Chang ..... 482/146
5,632,711 A * 5/1997 Hwang ..... 482/147
5,665,033 A * 9/1997 Palmer ..... 482/71
5,683,333 A * 11/1997 Rodgers, Jr. ..... 482/57
5,807,210 A * 9/1998 Devlin ..... 482/52
5,876,307 A * 3/1999 Stearns et al. ..... 482/51
5,879,276 A * 3/1999 Miller ..... 482/146
5,913,568 A * 6/1999 Brightbill et al. ..... 297/258.1
5,941,807 A * 8/1999 Cassidy et al. ..... 482/146
6,079,782 A * 6/2000 Berg et al. ..... 297/284.3
6,132,339 A * 10/2000 Wang et al. ..... 482/53
6,203,474 B1 3/2001 Jones
6,220,990 B1 * 4/2001 Crivello ..... 482/51
6,231,484 B1 * 5/2001 Gordon ..... 482/71
6,273,841 B1 * 8/2001 Johnston ..... 482/51
6,390,953 B1 * 5/2002 Maresh et al. ..... 482/52
6,475,120 B2 * 11/2002 Johnston ..... 482/51

(Continued)

FOREIGN PATENT DOCUMENTS

GB 2 360 000 A 9/2001

(Continued)

*Primary Examiner*—Loan H Thanh
*Assistant Examiner*—Robert F Long
(74) *Attorney, Agent, or Firm*—Andrus, Sceales, Starke & Sawall, LLP

(57) ABSTRACT

Exercise apparatus is provided with a coupled mechanism providing coupled natural biomechanical three dimensional human motion.

14 Claims, 5 Drawing Sheets

U.S. PATENT DOCUMENTS 6,500,106 B1 12/2002 Fulks
6,533,709 B1 3/2003 Jones
6,579,213 B1 6/2003 Webber et al.
6,595,899 B2 * 7/2003 Liang ..... 482/53
6,656,092 B1 12/2003 Fulks
6,669,610 B2 * 12/2003 Slowinski ..... 482/146
6,676,579 B1 * 1/2004 Lin ..... 482/146
6,695,755 B1 * 2/2004 Huang ..... 482/146
6,746,385 B1 6/2004 Habing
6,849,032 B2 * 2/2005 Chu ..... 482/51
6,899,657 B2 * 5/2005 Chuang ..... 482/52
6,902,514 B2 * 6/2005 Chuang ..... 482/52
D507,311 S * 7/2005 Butler et al. ..... D21/686
6,918,861 B2 * 7/2005 Liao et al. ..... 482/57
6,921,356 B1 7/2005 Habing et al.
6,988,977 B2 1/2006 Webber et al.
7,008,359 B2 * 3/2006 Fan et al. ..... 482/146
7,090,628 B2 * 8/2006 Badarneh ..... 482/140
7,128,694 B1 10/2006 Fulks
7,261,675 B2 * 8/2007 Kuo ..... 482/52
7,374,522 B2 * 5/2008 Arnold ..... 482/146
7,425,189 B1 * 9/2008 Eschenbach ..... 482/52
7,544,156 B2 * 6/2009 Webber ..... 482/99
2003/0022762 A1 * 1/2003 Jacobs et al. ..... 482/51
2003/0119633 A1 * 6/2003 Jacobs et al. ..... 482/70
2003/0125174 A1 * 7/2003 Lin ..... 482/148
2003/0199374 A1 * 10/2003 Perry et al. ..... 482/146
2004/0038784 A1 * 2/2004 Huang ..... 482/121
2004/0082439 A1 * 4/2004 Johnston et al. ..... 482/8
2004/0092366 A1 * 5/2004 Kyoung-chan et al. ..... 482/27
2004/0097335 A1 * 5/2004 Chu ..... 482/51
2004/0097336 A1 * 5/2004 Chuang ..... 482/52
2004/0097337 A1 * 5/2004 Chuang ..... 482/52
2004/0110609 A1 * 6/2004 Huang ..... 482/121
2004/0110613 A1 * 6/2004 Huang ..... 482/142
2006/0009329 A1 * 1/2006 Toyama et al. ..... 482/51
2006/0073938 A1 * 4/2006 German et al. ..... 482/51
2006/0073941 A1 * 4/2006 Perry et al. ..... 482/51
2006/0106326 A1 * 5/2006 Krebs et al. ..... 601/40
2006/0211543 A1 9/2006 Feldman et al.
2006/0264301 A1 * 11/2006 Kuo ..... 482/52
2006/0293153 A1 12/2006 Porth et al.
2007/0155495 A1 * 7/2007 Goo ..... 463/36
2007/0161462 A1 * 7/2007 Ho ..... 482/51
2007/0207900 A1 * 9/2007 Huang et al. ..... 482/51
2007/0213187 A1 * 9/2007 Morgan ..... 482/146
2008/0020902 A1 * 1/2008 Arnold ..... 482/51
2008/0020915 A1 * 1/2008 Pacheco et al. ..... 482/146
2008/0167164 A1 7/2008 Wang
2008/0214362 A1 * 9/2008 Eschenbach ..... 482/52
2008/0214363 A1 * 9/2008 Eschenbach ..... 482/52
2008/0234110 A1 * 9/2008 Webber et al. ..... 482/52
2008/0242517 A1 * 10/2008 Webber et al. ..... 482/52
2008/0287265 A1 * 11/2008 Giannelli et al. ..... 482/52

FOREIGN PATENT DOCUMENTS

WO 2005/032663 A1 4/2005

* cited by examiner

EXERCISE APPARATUS WITH COUPLED MOTION MECHANISM

CROSS-REFERENCE TO RELATED APPLICATION

Applicant notes commonly owned co-pending U.S. patent application Ser. No. 11/941,121, filed Nov. 16, 2007.

BACKGROUND AND SUMMARY

The invention relates to exercise apparatus for exercise movement of the limbs of the user in an exercise motion.

Exercise apparatus is known for supporting and guiding exercise movement including the limbs of the user in various motions. The motion can be uniplanar circular or elliptical, such as with bicycles, exercise apparatus, elliptical machines, and so on. The motion can be linear, such as linear sliding motion found in steppers, rowing machines, and so on. Some mechanisms allow planar motion in independent planes for each appendage or limb.

The present invention arose during continuing development efforts directed toward improved motion, including more natural human biomechanical motion, including three dimensional motion.

DETAILED DESCRIPTION

Figure 2:
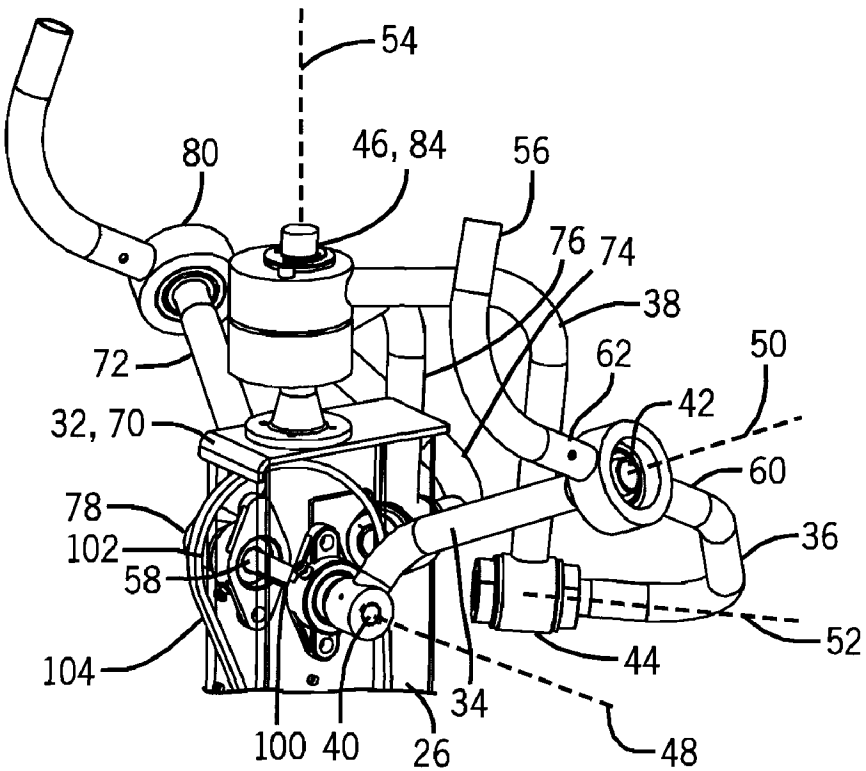
FIG. 2 is an enlarged view of a portion of FIG. 1 from a different angle.
Figure 1:
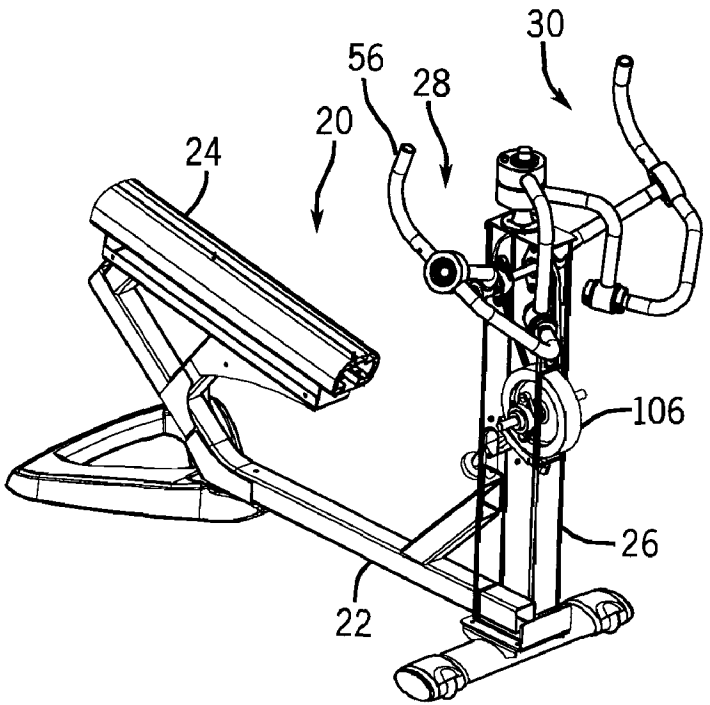
FIG. 1 is a perspective view of exercise apparatus.
Figure 3:
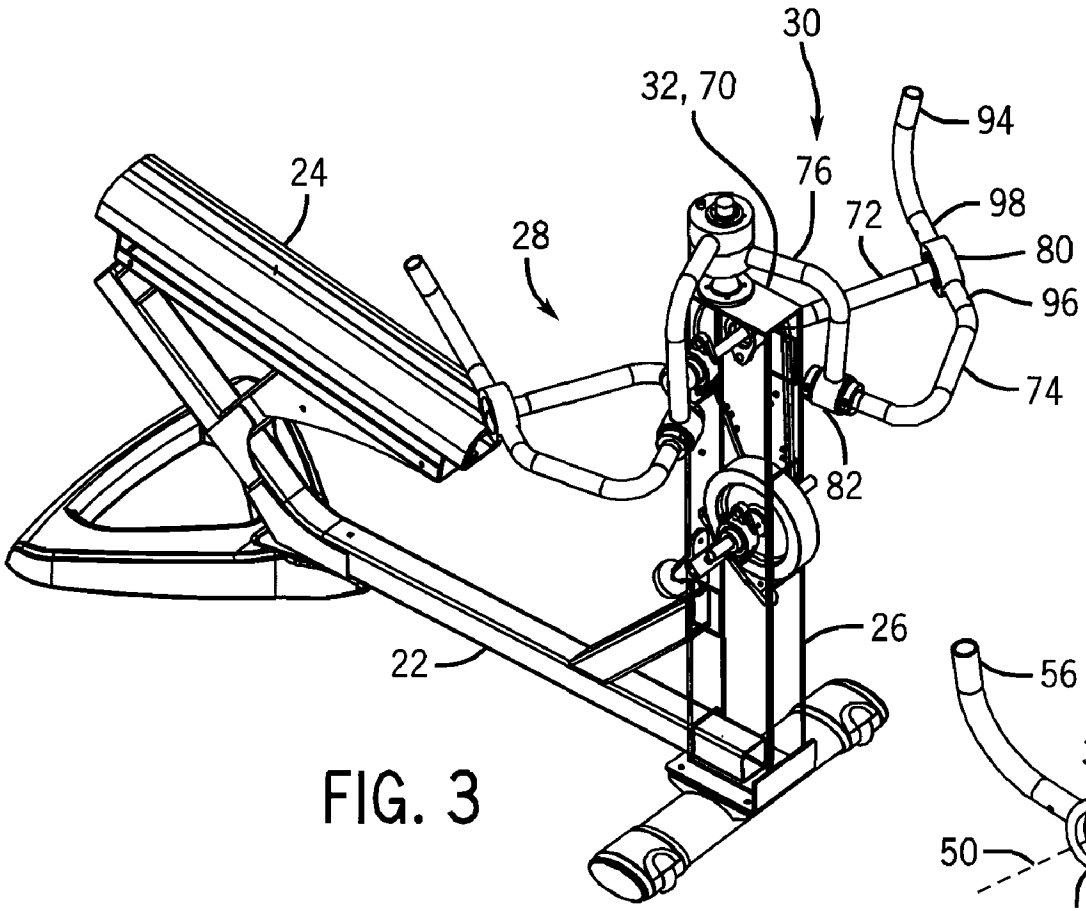
FIG. 3 is a view like FIG. 1 but showing movement to a different position.
Figure 4:
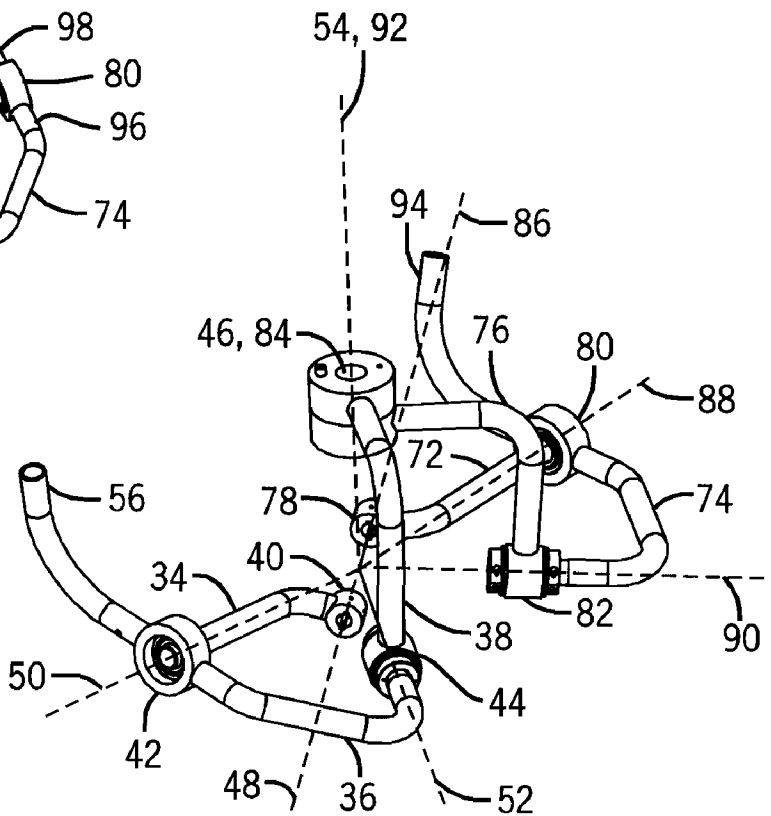
FIG. 4 is an enlarged view of a portion of FIG. 1 with selected components removed.

FIG. 1 shows exercise apparatus 20 including a frame 22 having a seat 24 for supporting a user, and an upwardly extending stanchion or post 26 supporting first and second four-bar mechanisms 28 and 30. Four-bar mechanism 28 has first, second, third, fourth links 32, 34, 36, 38, FIG. 2, connected respectively by first, second, third, fourth pivot joints 40, 42, 44, 46. First link 32 preferably does not move and is a ground link, or fixed link, or frame, as is commonly called. Second link 34 is preferably a grounded link or input link, as is commonly called. In the preferred embodiment, link 34 rotates 360°, and is hence also a crank, as is commonly called. Third link 36 is preferably a coupler or coupler link, as is commonly called. Fourth link 38 is preferably a grounded link or follower link, as is commonly called, and is preferably also a rocker, as is commonly called, because it is preferably opposite the input link 34 which is preferably a crank. First link 32 is connected to second link 34 at first pivot joint 40. Second link 34 is connected to third link 36 at second pivot joint 42. Third link 36 is connected to fourth link 38 at third pivot joint 44. Fourth link 38 is connected to first link 32 at fourth pivot joint 46. First and second links 32 and 34 pivot relative to each other about a first pivot axis 48 at first pivot joint 40. Preferably, link 32 is stationary, and link 34 pivots thereabout. Second and third links 34 and 36 pivot relative to each other about a second pivot axis 50 at second pivot joint 42. Third and fourth links 36 and 38 pivot relative to each other about a third pivot axis 52 at third pivot joint 44. Fourth and first links 38 and 32 pivot relative to each other about a fourth pivot axis 54 at fourth pivot joint 46. As noted, it is preferred that link 32 is stationary, and link 38 pivots thereabout.

At least one of the links, such as link 36, has a user-engagement surface, e.g. at handle 56, guiding movement of the user. For example, the user's right hand engages handle 56 which guides exercise arm movement of the user seated on seat 24. The user-engagement surface at handle 56 guides movement of the hand and arm of the user in three dimensional motion. First, second, third, fourth pivot axes 48, 50, 52, 54, respectively, all go through a common point 58. Accordingly, at least the link 36 including at user-engagement surface or handle 56 traverses along a sphere having a center at common point 58. The noted pivot joints are preferably provided by self-aligning pivots allowing some tolerance deviation and some tolerance window or volume constituting common point 58 such that the latter includes a tolerance zone or space permitting and accommodating tolerance deviation of the pivot joints. The term "common point" as used herein includes a tolerance zone or space around a singular unitary coordinate.

In the preferred embodiment, first link 32 is a ground link, second link 34 is a first grounded link, third link 36 is coupler link, and fourth link 38 is a second grounded link. Further in the preferred embodiment, second link 34 is an input link, and fourth link 38 is a follower link. Further in the preferred embodiment, first and fourth pivot axes 48 and 54 define a 90° angle therebetween at common point 58. Coupler link 36 has the noted user-engagement surface at handle 56. In the preferred embodiment, coupler link 36 has first and second segments 60 and 62 on distally opposite sides of second pivot joint 42 and extending in distally opposite directions from second pivot joint 42. First segment 60 extends from second pivot joint 42 to third pivot joint 44. Second segment 62 provides the noted user-engagement surface at handle 56. Further in the preferred embodiment, second link 34 is a crank input rotating in a rotary motion plane, and fourth link 38 is a rocker follower rocking in a rocking motion plane, wherein the rotary motion and rocking motion planes are non-coincident, and preferably non-parallel, and further preferably the noted rotary motion plane is transverse to the noted rocking motion plane.

The noted second four-bar mechanism 30 has fifth, sixth, seventh, eighth links 70, 72, 74, 76, respectively, FIGS. 1-4, connected respectively by fifth, sixth, seventh, eighth pivot joints 78, 80, 82, 84, respectively. Fifth link 70 is connected to sixth link 72 at fifth pivot joint 78. Sixth link 72 is connected to seventh link 74 at sixth pivot joint 80. Seventh link 74 is connected to eighth link 76 at seventh pivot joint 82. Eighth link 76 is connected to fifth link 70 at eighth pivot joint 84. In the preferred embodiment, first and fifth links 32 and 70 are the same, and fourth and eighth pivot joints 46 and 84 are the same. Fifth and sixth links 70 and 72 pivot relative to each other about a fifth pivot axis 86 at fifth pivot joint 78. In the preferred embodiment, fifth pivot axis 86 is the same as first pivot axis 48. Sixth and seventh links 72 and 74 pivot relative to each other about a sixth pivot axis 88 at sixth pivot joint 80. Seventh and eighth links 74 and 76 pivot relative to each other about a seventh pivot axis 90 at seventh pivot joint 82. Eighth and fifth links 76 and 70 pivot relative to each other about an eighth pivot axis 92 at eighth pivot joint 84. In the preferred embodiment, fourth and eighth pivot axes 54 and 92 are the same, and, as above noted, fourth and eighth pivot joints 46 and 84 are the same.

As noted above, one of the links, such as link 36, of the first four-bar mechanism 28 has a user-engagement surface 56 guiding movement of the user. One of the links, such as link 74, of the second four-bar mechanism 30 has a second user-engagement surface, for example at handle 94, guiding movement of the user. In one preferred embodiment, the apparatus provides an upper body exercise apparatus, wherein link 36 of the first four-bar mechanism 28 provides the first user-engagement surface 56 for the right hand of the user, and link 74 of the second four-bar mechanism 30 provides the second user-engagement surface for the left hand of the user. In the preferred embodiment, first and fifth links 32 and 70 are a common ground link, whereby the first and second four-bar mechanisms 28 and 30 share the same common ground link 32, 70. Further in the preferred embodiment, first and fifth pivot axes 48 and 86 are coincident. Further in the preferred embodiment, fourth and eighth pivot axes 54 and 92 are coincident. First and second user-engagement surfaces 56 and 94 guide movement of the user in respective three dimensional motions. First, second, third, fourth, fifth, sixth, seventh, eighth pivot axes 48, 50, 52, 54, 86, 88, 90, 92, respectively, all go through common point 58. User-engagement links 36 and 74 traverse along a sphere having a center at common point 58.

In the preferred embodiment, first link 32 is a ground link, second link 34 is a first grounded link, third link 36 is a first coupler link, fourth link 38 is a second grounded link, fifth link 70 is a second ground link, sixth link 72 is a third grounded link, seventh link 74 is a second coupler link, and eighth link 78 is a fourth grounded link. Further in the preferred embodiment, second link 36 is a first input link, fourth link 38 is a first follower link, sixth link 72 is a second input link, eighth link 76 is a second follower link, and the first and second ground links are common. Further in the preferred embodiment, first and fourth pivot axes 48 and 54 define a first 90° angle therebetween at common point 58, and fifth and eighth pivot axes 86 and 92 define a second 90° angle therebetween at common point 58. Further in the preferred embodiment, first coupler link 36 has the noted first user-engagement surface 56, and second coupler link 74 has the noted second user-engagement surface 94. First coupler link 36 has the noted first and second segments 60 and 62. Second coupler link 74 has third and fourth segments 96 and 98 on distally opposite sides of sixth pivot joint 80 and extending in distally opposite directions from sixth pivot joint 80. Third segment 96 extends from sixth pivot joint 80 to seventh pivot joint 82. Fourth segment 98 provides the noted second user-engagement surface 94. Pivot joints 40 and 78 are mounted on a common axle 100 rotatably supported on frame stanchion or post 26 and having a flywheel or pulley 102 connected via pulley belt 104 to a flywheel or pulley 106 which in turn can be driven by an electric motor or which may itself be the motive member which may drive an electrical generator for supplying power to a display or the like and/or which may be coupled to a resistance mechanism or brake for providing resistance to user motion.

FIGS. 5-9 show exercise apparatus with a coupled dual four-bar mechanism, and use like reference numerals from above where appropriate to facilitate to understanding.

Figure 6:
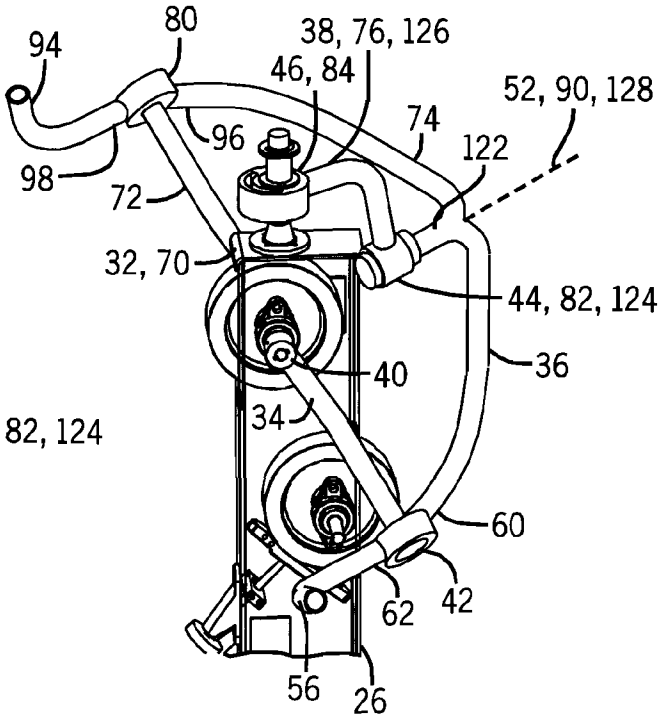
FIG. 6 is an enlarged view of a portion of FIG. 5 from a different angle.
Figure 5:
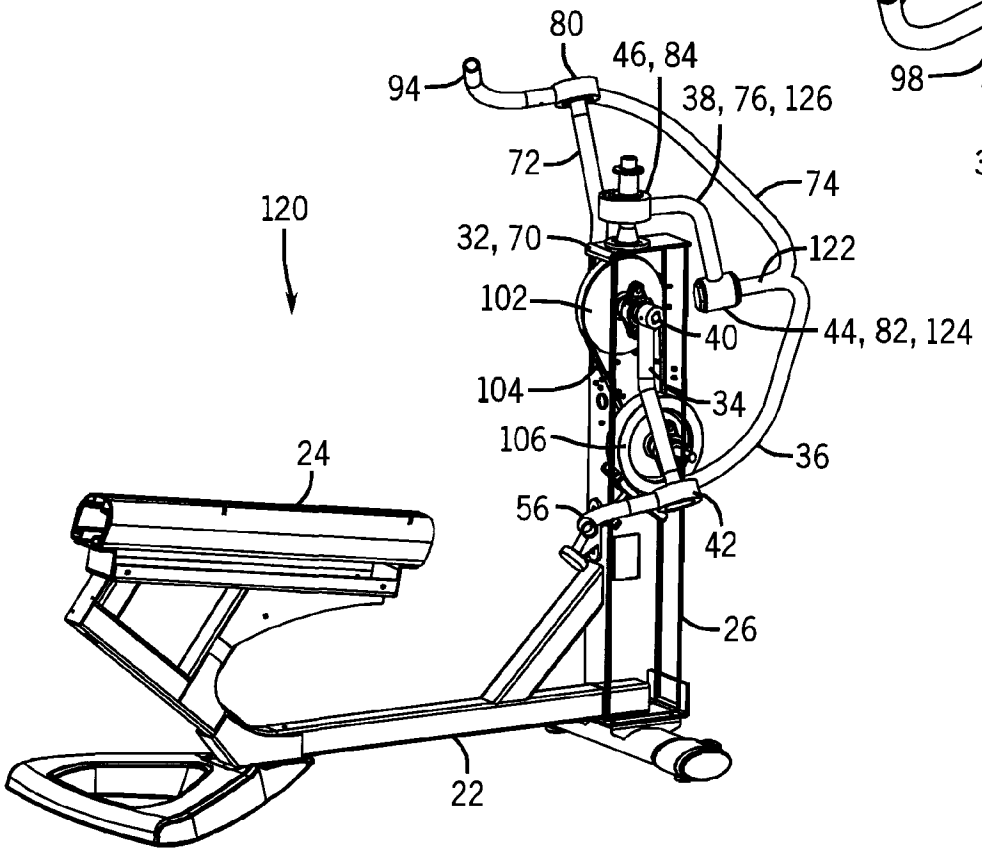
FIG. 5 is a perspective view of further exercise apparatus.

In the exercise apparatus 120 of FIGS. 5 and 6, the four-bar mechanisms 28 and 30 of FIGS. 1-4 are coupled at a common connection 122 coupling coupler links 36 and 74 to a common pivot joint 124 and common follower link 126. The first four-bar mechanism 28 is provided as above and includes first, second, third, fourth links 32, 34, 36, 38, respectively, connected respectively by first, second, third, fourth pivot joints 40, 42, 44, 46, respectively. First link 32 is connected to second link 34 at first pivot joint 40. Second link 34 is connected to third link 36 at second pivot joint 42. Third link 36 is connected to fourth link 38 at third pivot joint 44. Fourth link 38 is connected to first link 32 at fourth pivot joint 46. First and second links 32 and 34 pivot relative to each other about first pivot axis 48 at first pivot joint 40. As noted above, first link 32 is preferably stationary, and second link 34 pivots thereabout. Second and third links 34 and 36 pivot relative to each other about second pivot axis 50 at second pivot joint 42. Third and fourth links 36 and 38 pivot relative to each other about third pivot axis 52 at third pivot joint 44. Fourth and first links 38 and 32 pivot relative to each other about fourth pivot axis 54 at fourth pivot joint 46. As noted above, first link 32 is preferably fixed, and fourth link 38 pivots thereabout. Second four-bar mechanism 30 has the noted fifth, sixth, seventh, eighth links 70, 72, 74, 76, respectively, connected respectively by fifth, sixth, seventh, eighth pivot joints 78, 80, 82, 84, respectively. Fifth link 70 is connected to sixth link 72 at fifth pivot joint 78. Sixth link 72 is connected to seventh link 74 at sixth pivot joint 80. Seventh link 74 is connected to eighth link 76 at seventh pivot joint 82. Eighth link 76 is connected to fifth link 70 at eighth pivot joint 84. Fifth and sixth links 70 and 72 pivot relative to each other about fifth pivot axis 86 at fifth pivot joint 78. Fifth link 70 is preferably stationary, and sixth link 72 pivots thereabout. Sixth and seventh links 72 and 74 pivot relative to each other about sixth pivot axis 88 at sixth pivot joint 80. Seventh and eighth links 74 and 76 pivot relative to each other about seventh pivot axis 90 at seventh pivot joint 82. Eighth and fifth links 76 and 70 pivot relative to each other about eighth pivot axis 92 at eighth pivot joint 84. Fifth link 70 is preferably stationary, and eighth link 76 pivots thereabout.

One of the links such as 36 of the first four-bar mechanism 28 has the noted first user-engagement surface 56 guiding movement of a first body part of the user, for example the user's right hand. One of the links such as 74 of the second four-bar mechanism 30 has the noted second user-engagement surface 94 guiding movement of a second body part of the user, for example the user's left hand. A given link such as 36 of the first four-bar mechanism is connected to a given link such as 74 of the second four-bar mechanism 30 at the noted common connection 122. The first user-engagement surface 56 guides movement of the noted first body part of the user in three dimensional motion. The noted second user-engagement surface 94 guides movement of the noted second body part of the user in three dimensional motion. First, second, third, fourth, fifth, sixth, seventh, eighth pivot axes 48, 50, 52, 54, 86, 88, 90, 92, respectively, all go through the noted common point 58. At least the third and seventh links 36 and 74 traverse along a sphere having a center at common point 58.

In the preferred embodiment, first link 32 is a first ground link, second link 34 is a first grounded link, third link 36 is a first coupler link, fourth link 38 is a second grounded link, fifth link 70 is a second ground link, sixth link 72 is a third grounded link, seventh link 74 is a second coupler link, and eighth link 76 is a fourth grounded link. Third and seventh pivot joints 44 and 82 are provided by a common pivot 124. First and fifth links 32 and 70 are provided by a common ground link, as above. Fourth and eighth links 38 and 76 are provided by a common rocker link at 126. First coupler link 36 has the noted first user-engagement surface 56. Second coupler link 74 has the noted second user-engagement surface 94. The first and second coupler links 36 and 74 are connected to each other at common connection 122 at common pivot 124 providing the noted third and seventh pivot joints 44 and 82.

In the preferred embodiment, second and sixth links 34 and 72 are spaced on distally opposite sides of common point 58 and extend distally oppositely relative thereto. Further in the preferred embodiment, first and fifth pivot axes 48 and 86 are coincident, and fourth and eighth pivot axes 54 and 92 are coincident and define a 90° angle between the noted coincident first and fifth pivot axes 48 and 86 at common point 58. Further in the preferred embodiment, third and seventh pivot axes 52 and 90 are coincident at 128 at common pivot 124.

The exercise apparatus 120 of FIGS. 5 and 6 provides an upper body exercise apparatus wherein the first user-engagement surface 56 of first coupler link 36 is engaged by the right hand of the user, and the second user-engagement surface 94 of the second coupler link 74 is engaged by the left hand of the user. First coupler link 36 includes the noted first and second segments 60 and 62 on distally opposite sides of second pivot joint 42 and extending in distally opposite directions from second pivot joint 42. First segment 60 extends from second pivot joint 42 to third pivot joint 44 at common pivot 124. Second segment 62 provides the noted first user-engagement surface at handle 56. Second coupler link 74 has the noted third and fourth segments 96 and 98 on distally opposite sides of sixth pivot joint 80 and extending in distally opposite directions from sixth pivot joint 80. Third segment 96 extends from sixth pivot joint 80 to seventh pivot joint 82 at common pivot 124. Fourth segment 98 provides the noted second user-engagement surface at handle 94.

Figures 7, 8:
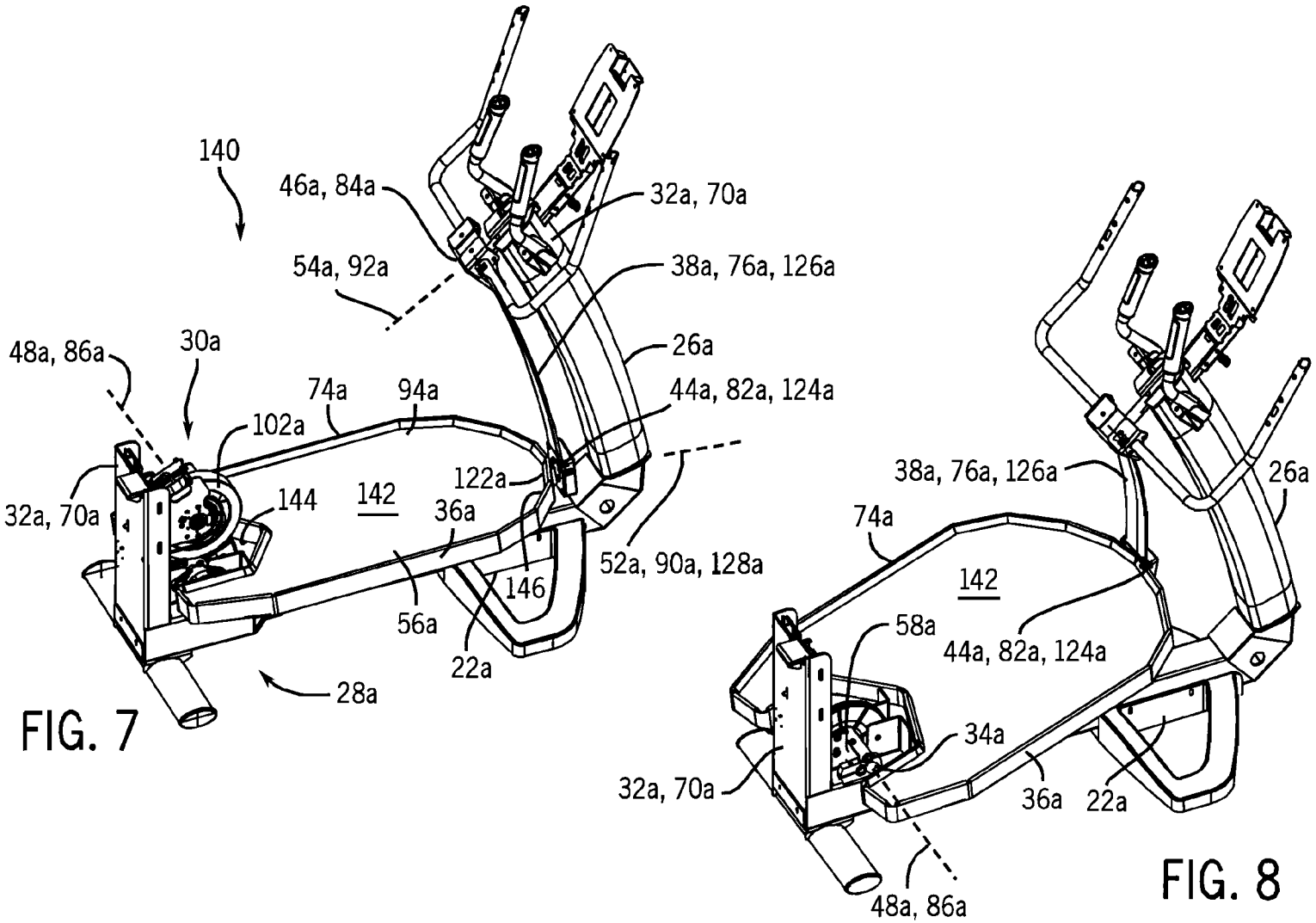
FIG. 7 is a perspective view of another embodiment of exercise apparatus.
FIG. 8 is like FIG. 7 and shows a further motion position thereof.
Figure 9:
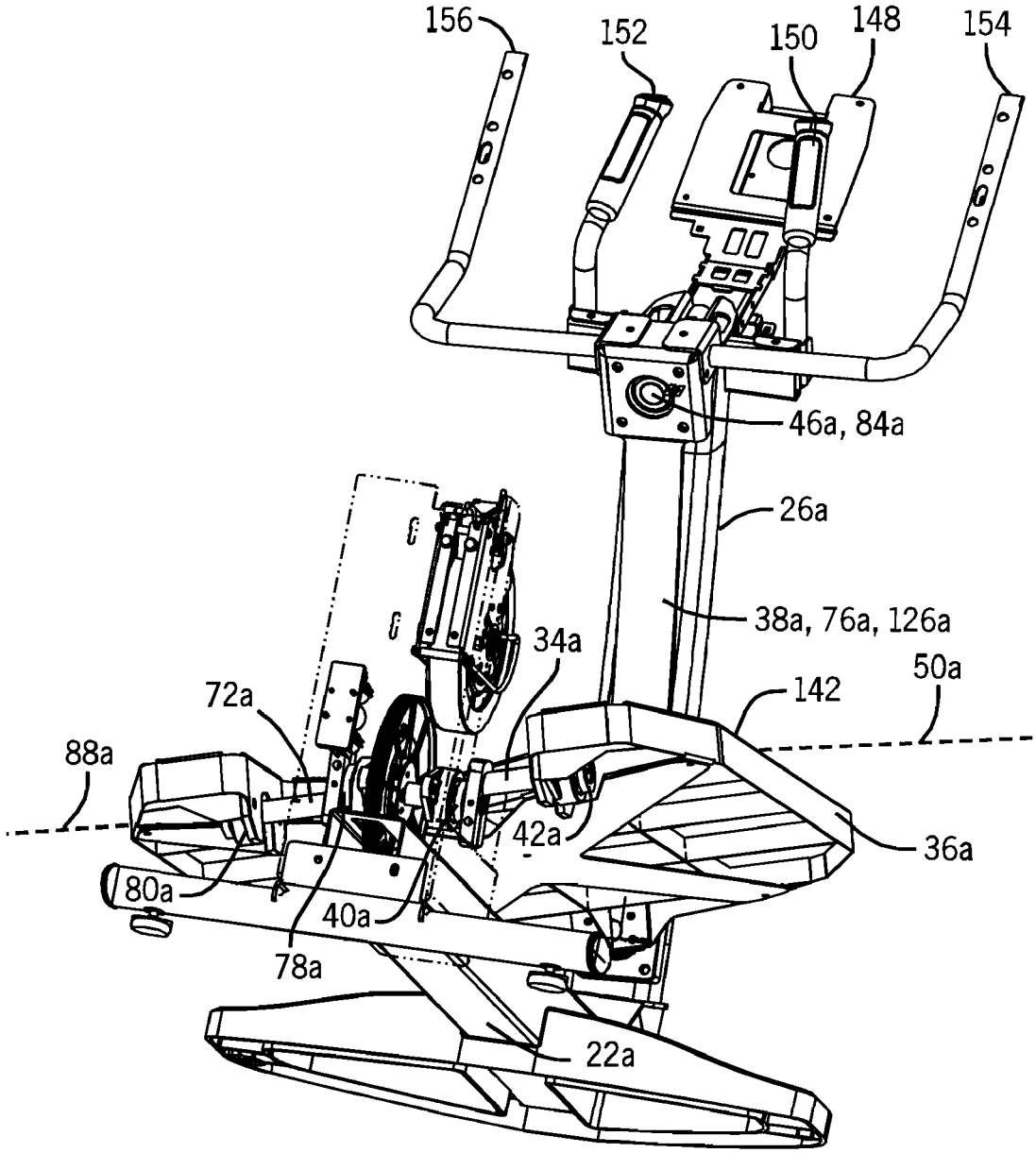
FIG. 9 is a perspective view of the apparatus of FIG. 7 from a different angle.

FIGS. 7-9 show exercise apparatus 140 providing a lower body exercise apparatus and use like reference numerals from above with the postscript "a" where appropriate to facilitate understanding. The apparatus includes a frame 22*a* having an upstanding stanchion post 26*a*, and a coupled dual four-bar mechanism provided by first and second four-bar mechanisms 28*a* and 30*a*. First four-bar mechanism 28*a* includes first, second, third, fourth links 32*a*, 34*a*, 36*a*, 38*a*, respectively, connected respectively by first, second, third, fourth pivot joints 40*a*, 42*a*, 44*a*, 46*a*. First link 32*a* is connected to second link 34*a* at first pivot joint 40*a*. Second link 34*a* is connected to third link 36*a* at second pivot joint 42*a*. Third link 36*a* is connected to fourth link 38*a* at third pivot joint 44*a*. Fourth link 38*a* is connected to first link 32*a* at fourth pivot joint 46*a*. First and second links 32*a* and 34*a* pivot relative to each other about a first pivot axis 48*a* at first pivot joint 40*a*. As above, it is preferred that first link 32*a* is a fixed, stationary ground link, and link 34*a* pivots thereabout. Second and third links 34*a* and 36*a* pivot relative to each other about a second pivot axis 50*a* at second pivot joint 42*a*. Third and fourth links 36*a* and 38*a* pivot relative to each other about a third pivot axis 52*a* at third pivot joint 44*a*. Fourth and first links 38*a* and 32*a* pivot relative to each other about a fourth pivot axis 54*a* at fourth pivot joint 46*a*. As noted above, it is preferred that first link 32*a* is a fixed, stationary ground link, and link 38*a* pivots thereabout. Second four-bar mechanism 30*a* has fifth, sixth, seventh, eighth links 70*a*, 72*a*, 74*a*, 76*a*, respectively, connected respectively by fifth, sixth, seventh, eighth pivot joints 78*a*, 80*a*, 82*a*, 84*a*, respectively. Fifth link 70*a* is connected to sixth link 72*a* at fifth pivot joint 78*a*. Sixth link 72*a* is connected to seventh link 74*a* at sixth pivot joint 80*a*. Seventh link 74*a* is connected to eighth link 76*a* at seventh pivot joint 82*a*. Eighth link 76*a* is connected to fifth link 70*a* at eighth pivot joint 84*a*. One of the links such as 36*a* of the first four-bar mechanism 28*a* has a first user-engagement surface 56*a* guiding movement of a first body part of the user, for example the user's right foot. One of the links such as 74*a* of the second four-bar mechanism 30*a* has a second user-engagement surface 94*a* guiding movement of a second body part of the user, for example the user's left foot. A given link such as 36*a* of the first four-bar mechanism 28*a* is connected to a given link such 74*a* of the second four-bar mechanism 30*a* at a common connection such as 122*a*.

In one preferred embodiment, user engagement surfaces 56*a* and 94*a* are provided by a common platform 142 secured to coupler links 36*a* and 74*a*. The first user-engagement surface 56*a* is provided by the right side of the platform 142 and guides movement of the right foot and right leg of the user in three dimensional motion. The second user-engagement surface 94*a* is provided by the left side of the platform 142 and guides movement of the left foot and left leg of the user in three dimensional motion. Further in the preferred embodiment, first, second, third, fourth, fifth, sixth, seventh, eighth pivot axes 48*a*, 50*a*, 52*a*, 54*a*, 86*a*, 88*a*, 90*a*, 92*a*, respectively, all go through common point 58*a*. Further in the preferred embodiment, at least the third and seventh links 36*a* and 74*a* traverse along a sphere having a center at common point 58*a*. Further in the preferred embodiment, first link 32*a* is a first ground link, second link 34*a* is a first grounded link, third link 36*a* is a first coupler link, fourth link 38*a* is a second grounded link, fifth link 70*a* is a second ground link, sixth link 72*a* is a third grounded link, seventh link 74*a* is a second coupler link, and eighth link 76*a* is a fourth grounded link.

As noted above, the exercise apparatus 140 of FIGS. 7-9, providing a lower body exercise apparatus, has the noted first user-engagement surface 56*a* of first coupler link 36*a* engaged by the right foot of the user, and has the noted second user-engagement surface 94*a* of the second coupler link 74*a* engaged by the left foot of the user. Common platform 142 spans first and second coupler links 36*a* and 74*a* and provides a feet support for the user. The platform has the noted right portion 56*a* for supporting the right foot of the user for engagement with the first coupler link 36*a*, and has the noted left portion 94*a* for supporting the left foot of the user for engagement with the second coupler link 74*a*. Platform 142 pivots about common pivot 124*a* between a rightwardly tilted position, FIG. 8, and a leftwardly tilted position, FIG. 9, each relative to horizontal. In the preferred embodiment, the maximum angle of tilt of the rightward tilted position relative to horizontal is less than about 15°, and the maximum angle of tilt of the leftward tilted position relative to horizontal is less than about 15°, though other angles may be used. In the preferred embodiment, common pivot 124*a* is provided by the noted third and seventh pivot joints 44*a* and 82*a*.

Platform 142 has the noted right and left sides 56*a* and 94*a* connected respectively to third and seventh links 36*a* and 74*a* providing the noted first and second coupler links, respectively. Platform 142 extends back to front between rearward and forward ends 144 and 146. The platform is forward of the noted first and fifth pivot joints 40*a* and 78*a*, and is rearward of common pivot 124*a*. In further embodiments, the platform may extend rearwardly of the noted first and fifth pivot joints.

In the preferred embodiment of FIGS. 7-9, second link 34*a* is a first crank input rotating in a first rotary motion plane, and sixth link 72*a* is a second crank input rotating in a second rotary motion plane. Fourth and eighth links 38*a* and 76*a* are provided by a common rocker follower 126*a* rocking in a rocking motion plane. It is preferred that the noted rocking motion plane is non-coincident with each of the noted first and second rotary motion planes. It is further preferred that the first and second rotary motion planes are parallel. It is further preferred that the noted rocking motion plane is non-parallel to each of the noted first and second rotary motion planes. It is further preferred that the noted rocking motion plane is transverse to each of the noted first and second rotary motion planes. The apparatus may be provided with a display such as 148. An inner pair of stationary handlebars 150 and 152 may be mounted to stanchion post 26*a*. An outer pair of handlebars 154 and 156 may be mounted to link 38*a*, 76*a*, 126*a* for rotation therewith about pivot joint 46*a*, 84*a*. In the preferred embodiment, the sum of the angles respectively between the noted first, second, third, and fourth pivot axes is less than 360°, and the sum of the angles respectively between the noted fifth, sixth, seventh, and eighth pivot axes is less than 360°. Further in the preferred embodiment, the noted second and sixth links are respective first and second crank inputs 180° out of phase with each other, and in a yet further embodiment are in-phase with each other. In further embodiments, a flexible rocking link is provided by 38*a*, 76*a*, 126*a*.

In the foregoing description, certain terms have been used for brevity, clearness, and understanding. No unnecessary limitations are to be implied therefrom beyond the requirement of the prior art because such terms are used for descriptive purposes and are intended to be broadly construed. The different configurations, systems, and method steps described herein may be used alone or in combination with other configurations, systems and method steps. It is to be expected that various equivalents, alternatives and modifications are possible within the scope of the appended claims.

What is claimed is:

1. Exercise apparatus comprising a coupled dual four-bar mechanism comprising first and second four-bar mechanisms, said first four-bar mechanism comprising first, second, third, and fourth links connected respectively by first, second, third and fourth pivot joints, said first link being connected to said second link at said first pivot joint, said second link being connected to said third link at said second pivot joint, said third link being connected to said fourth link at said third pivot joint, said fourth link being connected to said first link at said fourth pivot joint, said first and second links pivoting relative to each other about a first pivot axis at said first pivot joint, said second and third links pivoting relative to each other about a second pivot axis at said second pivot joint, said third and fourth links pivoting relative to each other about a third pivot axis at said third pivot joint, said fourth and first links pivoting relative to each other about a fourth pivot axis at said fourth pivot joint, said second four-bar mechanism comprising fifth, sixth, seventh, and eighth links connected respectively by fifth, sixth, seventh, and eighth pivot joints, said fifth link being connected to said sixth link at said fifth pivot joint, said sixth link being connected to said seventh link at said sixth pivot joint, said seventh link being connected to said eighth link at said seventh pivot joint, said eighth link being connected to said fifth link at said eighth pivot joint, said fifth and sixth links pivoting relative to each other about a fifth pivot axis at said fifth pivot joint, said sixth and seventh links pivoting relative to each other about a sixth pivot axis at said sixth pivot joint, said seventh and eighth links pivoting relative to each other about a seventh pivot axis at said seventh pivot joint, said eighth and fifth links pivoting relative to each other about an eighth pivot axis at said eighth pivot joint, one of said links of said first four-bar mechanism having a first user-engagement surface guiding movement of a first body part of a user, one of said links of said second four-bar mechanism having a second user-engagement surface guiding movement of a second body part of said user, a given link of said first four-bar mechanism being connected to a given link of said second four-bar mechanism at a common connection, wherein said first user-engagement surface guides movement of said first body part of said user in three dimensional motion via the first, second, third, and fourth links pivoting about their respective pivot axes, and said second user-engagement surface guides movement of said second body part of said user in three dimensional motion via the fifth, six, seventh, and eighth links pivoting about their respective pivot axes.

2. The exercise apparatus according to claim 1 wherein said first link is a first ground link, said second link is a first grounded link, said third link is a first coupler link, said fourth link is a second grounded link, said fifth link is a second ground link, said sixth link is a third grounded link, said seventh link is a second coupler link, and said eighth link is a fourth grounded link.

3. The exercise apparatus according to claim 2 wherein said first and fifth links comprise a common ground link, said fourth and eighth links comprise a common rocker link, said first coupler link has said first user-engagement surface, said second coupler link has second user-engagement surface, said first and second coupler links are connected to each other at said common connection, and said common connection comprises said third and seventh pivot joints.

4. The exercise apparatus according to claim 3 wherein said second and sixth links are spaced on distally opposite sides of said common point and extend distally oppositely relative thereto.

5. The exercise apparatus according to claim 4 wherein said first and fifth pivot axes are coincident, and said fourth and eighth pivot axes are coincident and define a 90 degree angle between said coincident first and fifth pivot axes at said common point.

6. The exercise apparatus according to claim 4 wherein said third and seventh pivot axes are coincident at said common pivot.

7. The exercise apparatus according to claim 1 wherein said first, second, third, fourth, fifth, sixth, seventh, and eighth pivot axes all go through a common point.

8. The exercise apparatus according to claim 7 wherein at least said third and seventh links traverse along a sphere having a center at said common point.

9. The exercise apparatus according to claim 2 wherein said one link of said first four-bar mechanism is said first coupler link, said one link of said second four-bar mechanism is said second coupler link.

10. The exercise apparatus according to claim 2 wherein said given link of said first four-bar mechanism is said first coupler link, said given link of said second four-bar mechanism is said second coupler link, and said common connection comprises a common pivot comprising said third and seventh pivot joints.

11. The exercise apparatus according to claim 2 wherein said exercise apparatus comprises an upper body exercise apparatus wherein said first user-engagement surface of said first coupler link is engaged by the right hand of said user, and said second user-engagement surface of said second coupler link is engaged by the left hand of said user.

12. The exercise apparatus according to claim 11 wherein said first coupler link comprises first and second segments on distally opposite sides of said second pivot joint and extending in distally opposite directions from said second pivot joint, said first segment extending from said second pivot joint to said third pivot joint, said second segment providing said first user-engagement surface, and said second coupler link comprises third and fourth segments on distally opposite sides of said sixth pivot joint and extending in distally opposite directions from said sixth pivot joint, said third segment extending from said sixth pivot joint to said seventh pivot joint, said fourth segment providing said second user-engagement surface.

13. Exercise apparatus comprising a coupled dual four-bar mechanism comprising first and second four-bar mechanisms, said first four-bar mechanism comprising first, second, third, and fourth links connected respectively by first, second, third and fourth pivot joints, said first link being connected to said second link at said first pivot joint, said second link being connected to said third link at said second pivot joint, said third link being connected to said fourth link at said third pivot joint, said fourth link being connected to said first link at said fourth pivot joint, said first and second links pivoting relative to each other about a first pivot axis at said first pivot joint, said second and third links pivoting relative to each other about a second pivot axis at said second pivot joint, said third and fourth links pivoting relative to each other about a third pivot axis at said third pivot joint, said fourth and first links pivoting relative to each other about a fourth pivot axis at said fourth pivot joint, said second four-bar mechanism comprising fifth, sixth, seventh, and eighth links connected respectively by fifth, sixth, seventh, and eighth pivot joints, said fifth link being connected to said sixth link at said fifth pivot joint, said sixth link being connected to said seventh link at said sixth pivot joint, said seventh link being connected to said eighth link at said seventh pivot joint, said eighth link being connected to said fifth link at said eighth pivot joint, said fifth and sixth links pivoting relative to each other about a fifth pivot axis at said fifth pivot joint, said sixth and seventh links pivoting relative to each other about a sixth pivot axis at said sixth pivot joint, said seventh and eighth links pivoting relative to each other about a seventh pivot axis at said seventh pivot joint, said eighth and fifth links pivoting relative to each other about an eighth pivot axis at said eighth pivot joint, one of said links of said first four-bar mechanism having a first user-engagement surface guiding movement of a first body part of a user, one of said links of said second four-bar mechanism having a second user-engagement surface guiding movement of a second body part of said user, a given link of said first four-bar mechanism being connected to a given link of said second four-bar mechanism at a common connection, wherein said first, second, third, fourth, fifth, sixth, seventh, and eighth pivot axes all go through a common point.

14. The exercise apparatus according to claim 13 wherein said second link is a first crank input rotating in a first rotary motion plane and said sixth link is a second crank input rotating in a second rotary motion plane.

* * * * *